US005614894A

United States Patent [19]

Stanczyk

[11] Patent Number: 5,614,894

[45] Date of Patent: Mar. 25, 1997

[54] DEVICE TO DETECT PARTICULARLY ONE OR SEVERAL WHEELS OF A VEHICLE OR OF A WHEELED MOBILE ENGINE AND PROCESS FOR USING THIS DEVICE

[75] Inventor: Daniel Stanczyk, Jarny, France

[73] Assignee: Centre d'Etudes Techniques de 1'Est, Metz Cedex, France

[21] Appl. No.: 367,112

[22] PCT Filed: Jul. 6, 1993

[86] PCT No.: PCT/FR93/00699

§ 371 Date: Feb. 8, 1995

§ 102(e) Date: Feb. 8, 1995

[87] PCT Pub. No.: WO94/01847

PCT Pub. Date: Jan. 20, 1994

[30] Foreign Application Priority Data

Jul. 6, 1992 [FR] France ..... 92 08416

[51] Int. Cl.[6] ..... G08G 1/01

[52] U.S. Cl. ..... 340/933; 340/941; 340/934; 364/436; 364/437; 377/9

[58] Field of Search ..... 340/933, 941, 340/934; 377/9; 364/436, 437

[56] References Cited

U.S. PATENT DOCUMENTS 3,688,308 8/1972 Makoto et al. ..... 340/941
3,835,449 9/1974 Viracola ..... 340/933

*Primary Examiner*—Jeffery Hofsass
*Assistant Examiner*—Daryl C. Pope
*Attorney, Agent, or Firm*—Young & Thompson

[57] ABSTRACT

A device for detecting one or several wheels of a vehicle or of a wheeled engine and a process using this device. The device is constituted by at least one electromagnetic loop and by an evaluation unit. The electromagnetic loop or loops have a small dimension in the direction of the displacement of the vehicle or of the axis of the roadway, which is less than the diameter of the wheels of the vehicles to be identified, and a rectangular shape and/or a rectilinear arrangement disposed perpendicularly to the axis of the roadway, the loop or loops being sensitive in a distinct and opposed manner to the electromagnetic influences of the metallic masses moving in translation and in rotation, at the wheels of the vehicle.

18 Claims, 5 Drawing Sheets

X
1'
1"

1"
2
1"
ℓ
L 2
2

2

2

2

2'
2
1"

| Number of Axles | Total Weight Authorized | Classification | | Silhouettes |
|---|---|---|---|---|
| | | Category | Type | |
| 2 | 19 t. | P.1 | 1 | |
| 3 | 26 t. | P.2 | 2 | |
| | | | 3 | |
| 4 | 38 t. | P.3 | 4 | |
| | | | 7 | |
| 5 and 6 | 40 t. | P.4 | 5 | |
| | | | 6 | |
| | | | 8 | |
| | | | 9 | |
| | | | 10 | |
| | | | 11 | Others |
| | | | 12 | V.L. |

FIG. 22

DEVICE TO DETECT PARTICULARLY ONE OR SEVERAL WHEELS OF A VEHICLE OR OF A WHEELED MOBILE ENGINE AND PROCESS FOR USING THIS DEVICE

BACKGROUND OF THE INVENTION

1. Field of the Invention

The present invention relates to the field of analysis, identification and classification of vehicles or wheeled movable engines, and particularly when these latter move in the course of their normal use, and has for its object a device to detect particularly one or several wheels of a vehicle or a wheeled movable engine, as well as a process for the detection, analysis and classification of vehicles or engines using this device.

2. Discussion of the Related Art

There already exist at present different types of systems permitting identifying wheeled vehicles, among which can be cited particularly piezo-electric, resistive, optical, ultrasonic and hyperfrequency detectors, as well as devices with pneumatic tubes or again with electromagnetic loops.

This latter type of device of identification is now present in the form of a rectangular or two rectangular loops, of large sizes of the order of 1.5 m to 2 m (2 m being measured in the direction of the width of the highway), disposed on or in the roadway and permitting receiving a signal representative of the assembly of the body of the vehicle including the wheels detected during passage of this latter over the loop or loops. The shape of the received signal and, as the case may be, the offset between two signals received by two loops, disposed with a spacing between them in the direction of displacement of the vehicle, permit respectively determining the nature of the vehicle, whether it is light or heavy, as well as its speed of displacement. Such a device is particularly known from EP-A-0035960.

However, this known device does not permit a fine or exact identification of the detected vehicles permitting particularly their classification into the ten categories defined by the Organization of Cooperation and Economic Development (OCDE) or into the fourteen categories of the French System for the Collection of Data (SIREDO).

Thus, this device does not detect the number of axles of the vehicle and, to effect this detection, it is necessary to add to it a supplemental device of the pneumatic tube type or piezo-electric detector detecting the passage of the axles.

This results in a complex assembly requiring constant maintenance because of the presence of the mechanical type detectors, which are subject to high wear.

The present invention particularly has for its object to overcome the mentioned drawbacks.

To this end, it has for its object a device constituted by at least one electromagnetic loop positioned on the roadway or in the roadway and by a unit for the evaluation of the influence of the passage of a vehicle over said loop or loops, characterized in that the electromagnetic loop or loops, each comprised by one or several turns, have on the one hand a small dimension in the direction of displacement of the vehicles or the axis of the roadway, less than the diameter of the wheels of the vehicles to be identified, and, on the other hand, a preferably rectangular shape and/or an arrangement disposed perpendicularly to the axis of the roadway, the loop or loops being disposed at least on the one or two tracks along which rolling takes place on the roadway and sensitive, in a distinct and opposed manner, to the electromagnetic influences of the metallic masses of the body or chassis of the vehicles, on the one hand, and the metallic masses of the tires of the corresponding wheels, on the other hand.

The invention also relates to a process for the detection, analysis and classification of vehicles or wheeled engines using the mentioned device, characterized in that it consists in noting the electromagnetic influences, on the one hand, of the metallic masses of the body or chassis of a vehicle, on the other hand, the metallic masses of the tires of the wheels of said vehicle, in a distinct and opposed manner, by means of at least one electromagnetic loop, disposed on or in the roadway and having a small dimension in the direction of displacement of the vehicles or along the axis of the roadway, to produce a signal indicating the number and the position of the wheels, relative to each other and relative to the body or chassis of the vehicle, in identifying the precise nature of the analyzed vehicle and classifying this latter in the predetermined categories, based essentially on the number and longitudinal arrangement of the wheels or axles, and storing the recovered data for a definite interval to permit their ultimate use.

BRIEF DESCRIPTION OF THE DRAWINGS

The invention will be better understood from the following description, which relates to preferred embodiments, given by way of non-limiting example, and explained with reference to the accompanying schematic drawings, in which.

DESCRIPTION OF THE PREFERRED EMBODIMENT

Figure 1:
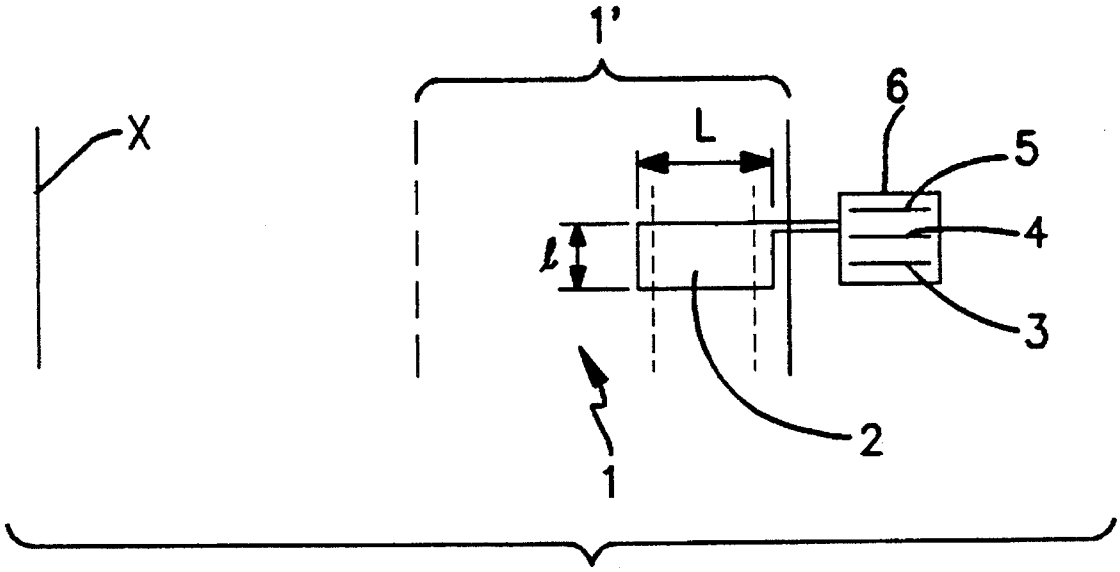
FIG. 1 represents in a schematic manner the device seen from above.
Figure 2:
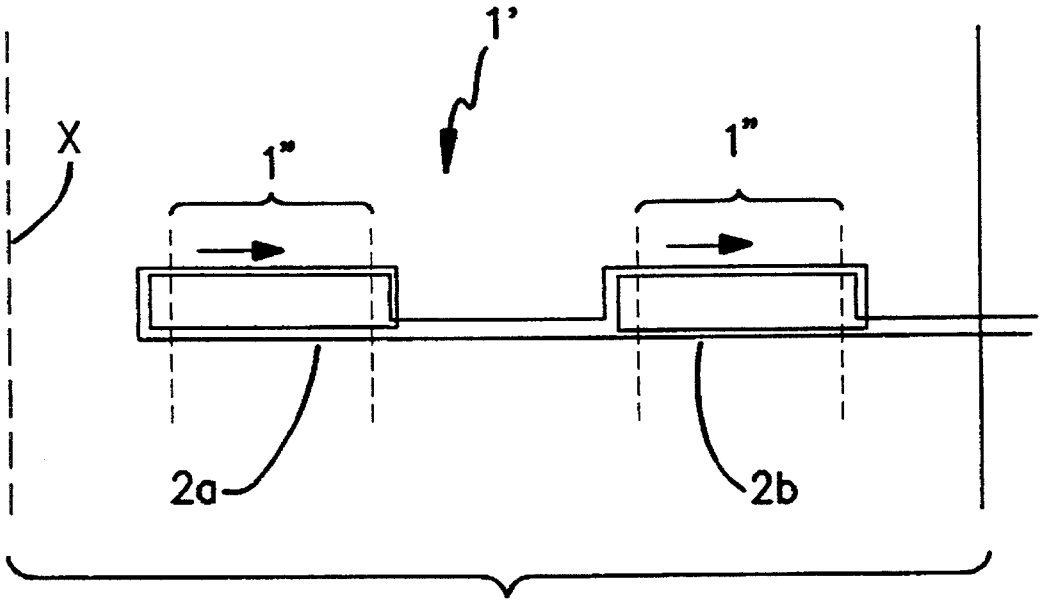
FIGS. 2 to 17 represent modified embodiments differing in number, shape and direction of winding of the loops which are part of the device according to the invention.

According to the invention, and as shown in FIGS. 1 to 21 of the accompanying drawings, the device to detect particularly one or several wheels of a vehicle or of a wheeled engine, comprising at least one electromagnetic loop and an evaluation unit, is essentially characterized in that the electromagnetic loop or loops 2, each comprised by one or several turns, have on the one hand a small dimension 1 in the direction of displacement of the vehicles or along the axis X of the roadway 1, less than the diameter of the wheels of the vehicles to be identified, and, on the other hand, a preferably rectangular shape and/or an arrangement disposed perpendicularly to the axis X of the roadway 1, the loop or loops 2 being disposed at least on one or both tracks 1" for movement along a lane 1' of the roadway 1 and sensitive, in a distinct and opposite manner, to the electromagnetic influences, on the one hand, of the metallic masses of the bodies of the vehicles (body, chassis, undercarriage) and, on the other hand, of the metallic masses of the corresponding wheels.

The loop or loops 2 preferably have an inductance comprised between 40 and 700 μH and is or are constituted of n windings (n being between 1 and 10) of an insulated conductive wire of about 0.2 to 3 $mm^2$ in cross section, disposed on or in the roadway 1.

According to a first characteristic of the invention, shown in FIG. 1 of the accompanying drawings, the evaluation unit is comprised, on the one hand, of an electromagnetic detector 3 receiving the frequency voltage variations (generated by the induced current) of an alternating signal passing through the loop or loops 2 which is connected to it and delivering a corresponding signal proportional to said variations, on the other hand, by a card 4 for processing the signal, analyzing the signal from said electromagnetic detector 3 and determining particularly by means of microprocessor means controlled by a computer program, the number of wheels belonging to a same vehicle so as to permit its classification and, finally, a memory 5 for storage of data delivered by said processing card, which can be read in situ and/or remotely, with ultimate transfer of its contents, the elements 3 to 5 of said evaluation unit being mounted in a protective casing, disposed adjacent to or remote from the highway 1.

The electromagnetic detector 3, for example of the type known by the designation SL29C and sold by the CFEE company (two path detector with automatic adjustment) detects therefore the resultant of the variations in voltage and of the frequency of an alternating signal in the loop or loops 2 done on the one hand to the metallic masses of the vehicle (body, undercarriage, chassis, motor in particular) and, on the other hand, to the metallic masses of the wheel or wheels, more particularly of the corresponding tire or tires, of the vehicle to be studied, particularly the variation in the inductance of the circuit constituted by each loop 2.

The frequency $f=1/(2\pi\sqrt{LC})$ of the oscillator thus constituted is compared to the frequency of a fixed oscillator. This frequency is applied to the input of a loop circuit with phase lock whose role is to supply a continuous voltage at its output relative to the input frequency. The resulting signal at the outlet of the twinned loop-detector is characteristic of the number of wheels and hence of the hubs but also of the body (body-chassis) of the vehicle representing its length and the distance of the latter relative to the roadway 1. The voltage variation due to a wheel, during its passage adjacent a loop, is of the order of 200 to 800 millivolts (for the resided type of detector—FIGS. 18 and 21) and is opposed in direction to the variation generated by the metallic masses associated with the body of this same vehicle.

Thus, a loop 2 according to the invention, associated with an electromagnetic detector 3, permits displaying in a distinct way the influence of the body or chassis of the vehicle and the influence of the wheels, more particularly of the tires, but also the discs, drums, rims, etc. on the frequency of the signal circulating in the loop or loops 2.

Thus, these influences generate opposed or inverse variations of frequency and of voltage of the signal as shown in FIGS. 18 to 21 which show voltage signals delivered by the electromagnetic detector 3 and whose amplitudes vary as a function of the variations of frequency of the signals circulating in the loops 2.

These results could be explained by the fact that the loop or loops 2 constituting a first circuit provided with a generator, the metallic masses of the vehicle, passing above such a circuit, generate a variation of magnetic field produced about said first circuit, and, as a result, a variation of the flux generated by a second circuit, constituted by the rotating metallic masses of the wheel and more particularly by the torus formed by the rim and the metallic armatures of the tire, during its passage above said first circuit.

This second circuit will therefore be the site of a current induced which obeys the law of LENZ.

Similarly, there is promoted a return induced current in said first circuit constituted by the loop or loops 2. But according to the mentioned law, the current induced will tend by its effects to the cause which it has given rise to, which explains the opposed variations of the received signals.

Moreover, the two mentioned circuits have between them a mutual inductance with variable permeability because of the presence of metallic elements moving in translation and metallic elements moving in rotation.

There will be seen precisely in FIGS. 18 to 21 the positive variations, in the form of a plateau or a flattened dome, generated by the body or the chassis of the vehicle in question and the peaks of negative variation generated by the rotating wheels of said vehicle (relative to the reference R of the signal in the form of a residual voltage of several volts corresponding to zero variation of the frequency of the voltage).

Figure 20:
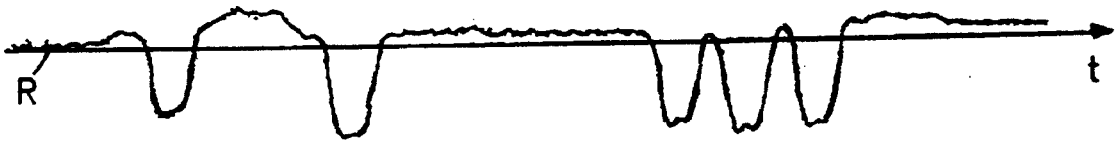
FIG. 20 represents the voltage signal at the output of the detector, generated by a tractor with two axles and its trailer with three axles.

It is also possible to note in FIG. 20 the small positive peaks, integrated in the negative peaks, corresponding to the movement, adjacent the loop 2 of the attributes of the wheel or wheels (suspension, axle arm, bridge, support, etc.)

It should also be noted that the amplitude of the received signals at the magnetic detector 3, is independent of the speed at which the vehicle passes over the loop or loops 2, from which follows an identical sensitivity of measurement and analysis at low speed and at high speed.

Moreover, it is also possible to determine, particularly for a heavy weight, the raising of one or several wheels or axles.

Figure 21:
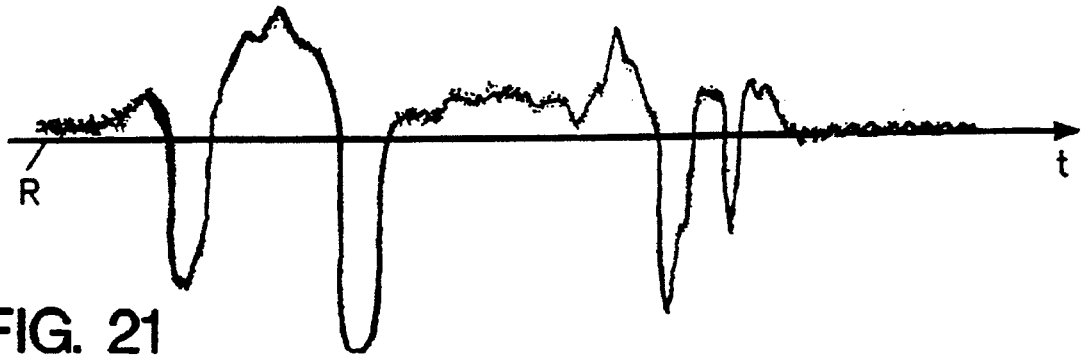
FIG. 21 represents the voltage signal, with a different sensitivity, at the output of the detector, generated by a tractor with two axles, and its trailer with three axles, of which the first axle is raised, and, FIG. 22 represents a table of the categories and their silhouettes identifiable by the device according to the invention.

Thus, as shown in FIG. 21 of the accompanying drawings, a raised wheel or axle gives rise to a variation of the signal in the same direction as the metallic mass of the body or chassis (see the positive peak preceding the two negative peaks in FIG. 21).

The computer program, derived as the case may be from a processing program of the known signal, as well as the signal processing card 4, permits advantageously the classification of the vehicles by category, discriminating between them by means of the number of axles, the distances between axles, the length of the body or of the chassis and the distances between the roadway and the bottom of the body, on the one hand, between the axles, and, on the other hand, before or after the axles.

These latter distances are specific characteristics of the morphology of certain vehicles, and particularly of buses and auto car having a low lateral metallic body.

According to a preferred embodiment of the invention, the dimension 1 or width of the loop or loops 2 in the direction of movement of the vehicles to be analyzed or the axis X of the roadway 1 is about the order of magnitude of the width of the bearing surface on the ground of the tires of the wheels of the vehicles to be analyzed (dimensions which are about similar).

Thus the width 1 of the loop or loops 2 is preferably of the order of 0.3 meter, for the detection of heavy-duty wheels and preferably of the order of 0.15 meter for the detection of the wheels of lightweight vehicles.

According to a first modification of the invention, shown in FIGS. 3 and 5 of the accompanying drawings, the detection device comprises one or two rectangular loops 2 having a length L comprised between 0.50 m and 1.20 m and each disposed on or below a rolling path 1" of a roadway 1', perpendicular to the longitudinal axis of this latter.

Figures 3, 4, 5, 6, 7, 8, 9, 10, 11:
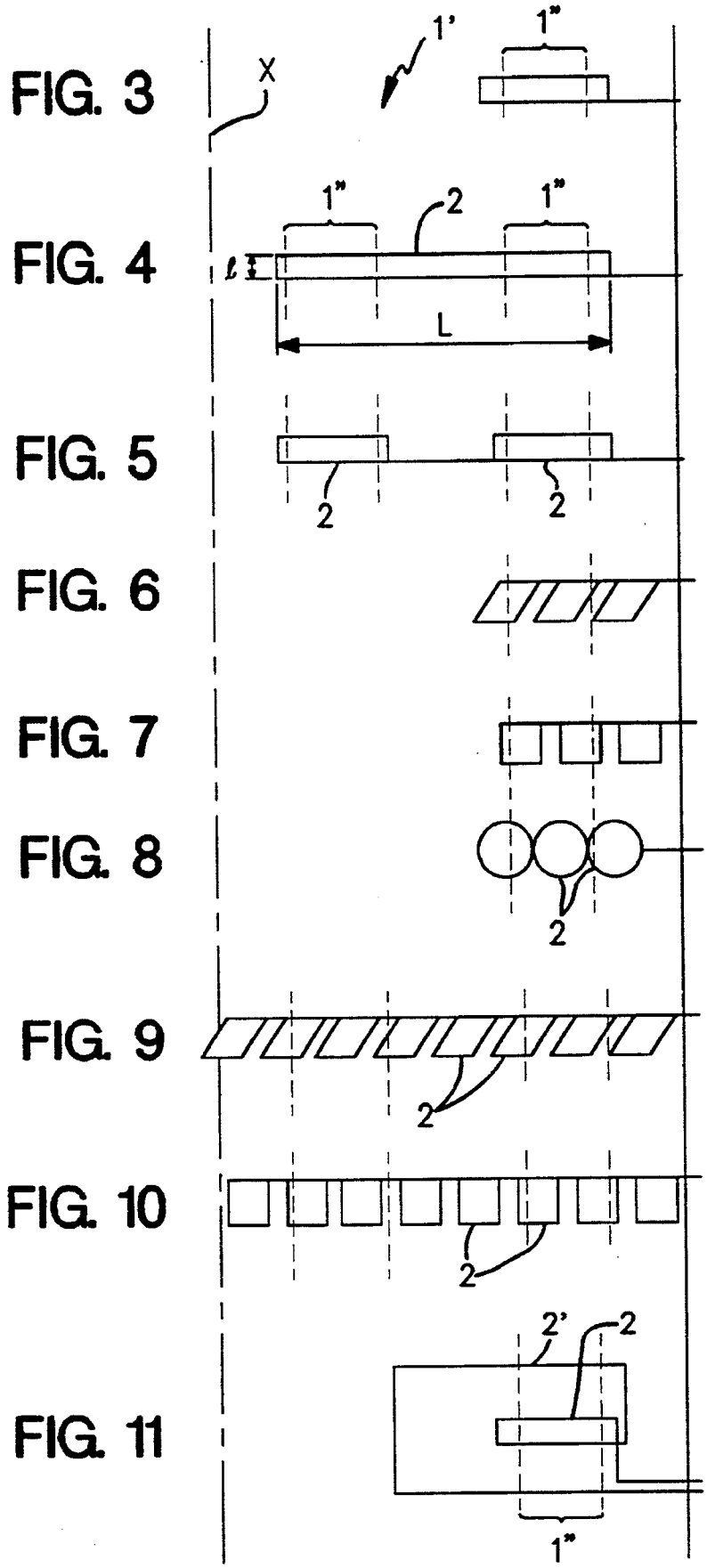
Figure 12:
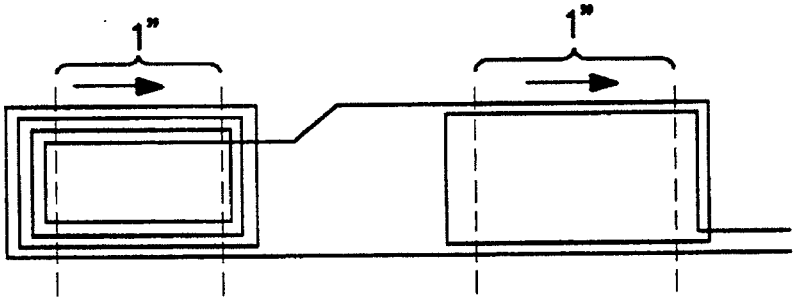
Figure 13:
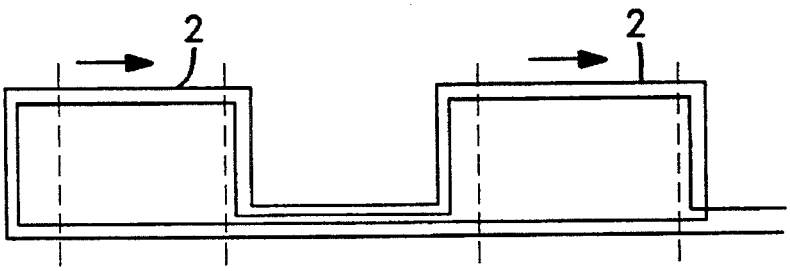
Figure 14:
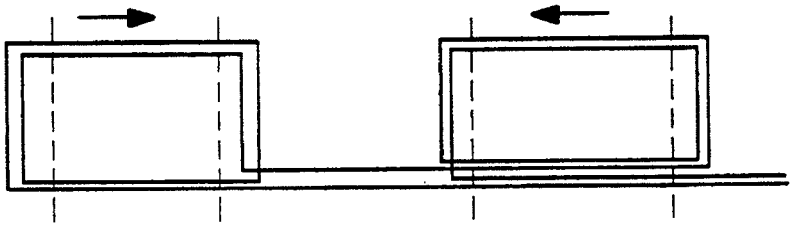
Figure 15:
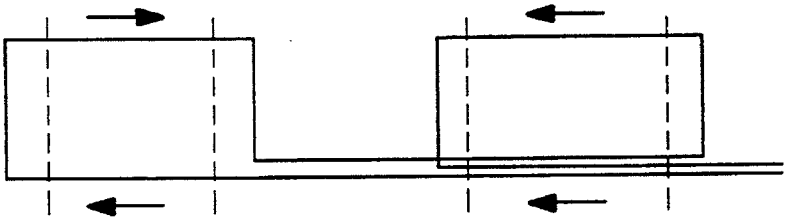
Figure 16:
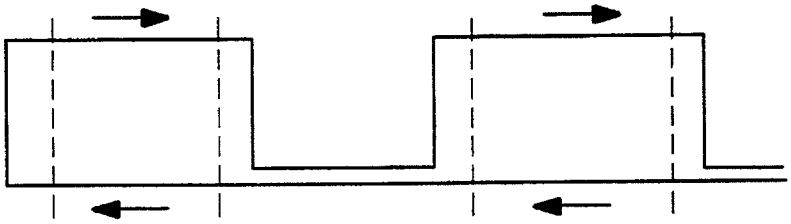
Figure 17:
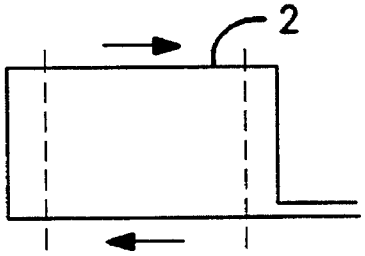
Figure 18:
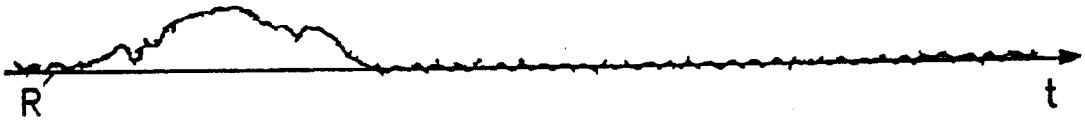
FIG. 18 represents the voltage signal generated by a car at the outlet of the electromagnetic detector forming a part of the device of the invention.
Figure 19:
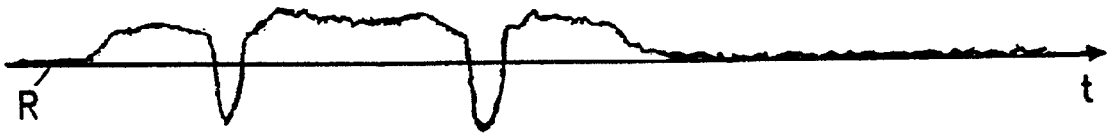
FIG. 19 represents the voltage signal at the outlet of the detector, generated by an automobile.

According to a second modification, shown in FIG. 4 of the accompanying drawings, said detection device comprises a single rectangular loop 2 including the two rolling tracks 1" of a lane 1'.

According to a third embodiment of the invention, shown in FIGS. 12 to 16 of the accompanying drawings, said detection device comprises an assembly of two loops 2, constituted by a same conductive wire connected to a single detector 3 and of which each is disposed on or below one of the two rolling tracks 1" of the wheels of a same lane 1' of the roadway 1, each of said loops 2 being adapted to have a given number of turns, which can be identical or different.

According to a fourth embodiment, there is provided an assembly of at least two loops 2, connected each to a separate electromagnetic detector 3 and disposed in an arrangement perpendicular to the axis X of the roadway 1 or to the direction of movement of the vehicles, said assembly of loops 2 extending either above or below a single rolling track 1" of the lane 1', or approximately over all the width of the lane 1', FIGS. 6 to 10).

Although the loop or loops 2 preferably have a rectangular shape, they can also be of difference shape, namely, parallelogram, square or round (FIGS. 6 to 10) or even oval or elliptical (not shown).

Moreover, in the case of an arrangement or an alignment of several loops 2, these latter could be separate, tangential (FIG. 8) or secantal.

For their installation on or within the roadway 1, the loop or loops 2 can be secured to one or two flexible and resistant sheets or strips, which can be woven, of identical or complementary characteristics and consisting for example of rubber, plastic, synthetic or resinous products, these sheets or strips being adapted to receive in sandwich fashion the wires of the turns of the loop or loops 2, to have a self-adhesive surface permitting sticking the loop or loops 2 to the roadway 1 and constituting themselves marking strips, for example stop lines, "yield" lines, centerlines or border lines or the like.

Thus, said loop or loops 2 can be secured to one of several sheets constituting temporary supports, if desired reticulated, disposed on the roadway 1 and secured together by a localized or overall coating penetrating the holes, these sheets being adapted to be biodegradable or soluble by the component particularly of the binder coating or by heat.

According to a characteristic of the invention, the detection device can moreover be associated or integrated with another system for the detection and reception of data relative to vehicles such as for example an electromagnetic loop device of large size, a piezo-electric detector, a resistive detector, a piezo-polymeric detector, an optical detector, a hyperfrequency detector or an ultrasonic detector, so as to receive supplemental data relative to the vehicle to be studied, permitting further refining the identification of said vehicle.

As shown in FIG. 11 of the accompanying drawings, the detection device according to the invention can also comprise a loop 2 of small dimension in the direction of movement of the vehicles, disposed within a loop 2' of larger size, the two loops 2 and 2' being comprised by the same deductive wire and connected to a same electromagnetic detector 3, permitting determining the length and the speed of displacement of the vehicle to be studied.

The present invention also has for its object a process for the detection, analysis and classification of wheeled vehicles using the device described above, characterized in that it consists in noting the electromagnetic influences, on the one hand, of the metallic masses of the body or chassis of the vehicle, and, on the other hand, of the metallic masses of the tires of the wheels of said vehicle, in a distinct and opposite manner, by means of at least one electromagnetic loop 2, disposed on or in the roadway 1 and having a small dimension in the direction of displacement of the vehicles or of the axis X of the roadway 1, to produce a signal indicating the number and position of the wheels, relative to each other and with respect to the body or chassis of the vehicle, to identify the precise nature of the vehicle analyzed and to classify this latter into predetermined categories, based essentially on the number and the longitudinal disposition of the wheels or axles, and to store the received data for a defined period of time for their ultimate use.

According to a characteristic of the invention, said process can consist particularly in noting the variation of electromagnetic magnitude or frequency or of the voltage of an alternating signal moving through the loop or loops 2, during passage of a vehicle over the latter, according to the electromagnetic influence, particularly as to the inductance of the loop or loops 2, of the body or chassis of the vehicle, on the one hand, and the tires of the corresponding wheels, on the other hand.

According to a modification of the invention, said process can consist, using several independent loops to dispose perpendicularly to the axis X of the roadway 1 and each producing its own signal, in noting transversely the position of one or several single or double wheels of a given vehicle, and therefore the position of this latter on the lane 1', and in scanning by longitudinal sections said vehicle, thereby preventing reconstituting the magnetic print or signature of said vehicle permitting its comparatively precise identification.

Preferably, said process permits also determining the length of the body or chassis and the distances between the roadway 1 and the bottom of the body between the axles, on the one hand, and in front of and behind the axles, on the other hand.

According to another modification of the invention, said process can also consist, by supplemental use of an ultrasonic detector, in determining the profile or silhouette of the vehicle to be analyzed, so as to be able to make a distinction between two vehicles both of which have five axles, but of which one comprises a platform and the other is covered.

According to another modification of the invention it is possible, by supplemental use of an electromagnetic loop 2' of large size, associated with a loop 2 as described above, these two loops being constituted by the same conductive wire (and hence arranged in series), also to determine, by analysis of the received signal, the speed of displacement and the length of the detected vehicles.

Thus, these latter data can be deduced from the distances between the successive fronts of the signal received by the electromagnetic detector 3 connected to said loops 2 and 2' corresponding to the passage of said vehicle by the loop 2 and the loop 2'.

According to one characteristic of the invention, the preliminary installation of the loop or loops 2 in the roadway 1 can preferably be effected by means of a rotary saw permitting obtaining prints or suitable cutouts of 2 to 3 cm width and depth in said roadway 1.

The device according to the invention is particularly adapted to:

counting axles, counting wheels, single or double, counting vehicles, counting vehicles by category the determination of the transverse position of the wheels relative to a reference, preferably the axis of the roadway, the determination of the transverse position of the vehicle relative to a reference, preferably the axis of the roadway, the determination of the longitudinal positioning of the wheels of a same vehicle permitting the classification by category, inter-axial distance, the detection of a typical vehicle by their signal, the discrimination between single and double wheels, the measurement of speed, inter-vehicle distance, vehicle length, the identification of atypical vehicles and aircraft for example on an airport.

Of course, the invention is not limited to the embodiments described and illustrated in the accompanying drawings. Modifications remain possible, particularly as to the construction of the various elements, or by substitution of technical equivalents, without thereby departing from the scope of protection of the invention.

I claim:

1. Device constituted by at least one electromagnetic loop positioned on or in the roadway and by an evaluation unit for the evaluation of the influence of a passage of a vehicle past said loop or loops, the electromagnetic loop or loops (2) being comprised each by one or several turns and having on the one hand a small dimension (1) in the direction of displacement of the vehicles or of the axis (X) of the roadway (1), and, on the other hand, a preferably rectangular shape and/or an arrangement disposed perpendicularly to the axis (X) of the roadway (1), the loop or loops (2) being disposed at least by one or two of the rolling tracks (1") of a lane (1') of the roadway (1), characterized in that the dimension (1) or width of the loop or loops (2) is about of the order of magnitude of the width of the bearing surface on the ground of the wheels of the vehicles to be analyzed, either preferably of the order of about 0.3 meter for the detection of heavy weights and of the order of about 0.15 meter for the detection of light vehicles and in that the evaluation unit is comprised, on the one hand, by an electromagnetic detector (3) noting the variations of voltage and of frequency of an alternating signal moving within the loop or loops (2) and which is connected to it, by virtue of the passage of a vehicle past the loop or loops (2) and delivering a proportional signal corresponding to said variations, on the other hand, of a processing card (4) of the signal analyzing the signal emitted from the electromagnetic detector (3) and determining particularly, by means of microprocessor means controlled by a computer program, the number of wheels belonging to a same vehicle for its classification and, finally, a memory (5) for storage of data delivered by said processing card, adapted to be read in situ and/or remotely, with transfer if desired of its contents, the elements (3 to 5) of said evaluation unit being mounted preferably in a protective casing, disposed adjacent or not to the roadway (1).

2. Device according to claim 1, characterized in that the computer program permits the classification of the vehicles by category, by discriminating between them by means of the number of axles, the distance between axles, the length of the body or chassis and the distances between the roadway and the bottom of the body, on the one hand, between the axles and, on the other hand, to the front or rear of the axles.

3. Device according to claim 1, characterized in that it comprises one or two rectangular loops (2) having a length (L) comprised between 0.50 m and 1.20 m and each disposed on or below a rolling track (1") of a lane (1') perpendicular to the longitudinal axis of this latter.

4. Device according to claim 1, characterized in that it comprises a single rectangular loop (2) for the two rolling tracks (1") of a lane (1').

5. Device according to claim 1, characterized in that it comprises an assembly of two loops (2), constituted by a same conductive wire connected to a single detector (3) and of which each is disposed on or below one of the two rolling tracks (1") of a same lane (1') of the roadway (1).

6. Device according to claim 1, characterized in that it comprises an assembly of at least two loops (2), each connected to a separate electromagnetic detector (3) and disposed in an alignment perpendicular to the axis (X) of the roadway (1) or to the direction of displacement of the vehicles, said loop assembly (2) extending either on or below a single rolling track (1") of the lane (1'), or over about all the length of the roadway (1).

7. Device according to claim 1, characterized in that the loop or loops (2) have a shape other than rectangular, such as for example a parallelogram, square, round, oval or elliptical shape and in that, in the case of an arrangement, alignment or assembly of several loops (2), these latter are separated, either tangentially or secantally, from each other.

8. Device according to claims 1, characterized in that the loop or loops (2) are secured to one or several flexible and resistant sheets or strips, which may be woven, of identical or complementary characteristics and consisting for example of rubber, plastic, synthetic or resinous products, these sheets or strips being adapted to sandwich the wires of the turns of the loop or loops (2), to have a self-adhesive face permitting adhesion of the loop or loops (2) to the roadway (1) and themselves constituting marking strips, for example stop lines, "yield" lines, centerlines or side lines.

9. Device according to claim 8, characterized in that the loop or loops (2) are secured to one or several sheets constituting temporary supports, articulated as the case may be, disposed on the roadway (1) and secured together by a localized or overall coating penetrating the openings, the sheets being adapted to be biodegradable or soluble by a component particularly of the binder of the coating or by heat.

10. Device according to claim 1, characterized in that it is associated or integrated with another detection system for the receipt of data relative to the vehicles such as for example an electromagnetic loop or large size, a piezoelectric detector, a resistive detector, a piezo-polymeric detector, an optical detector, a hyperfrequency detector or an ultrasonic detector, so as to receive supplemental data relative to the vehicle to be studied, permitting further refining the identification of said vehicle.

11. Device according to claim 1, characterized in that it comprises a loop (2) of small size in the direction of displacement of the vehicles, disposed in a larger loop (2'), the two loops (2 and 2') being made of the same conductor and connected to a same electromagnetic detector (3).

12. Process for the detection, analysis and classification of vehicles or wheeled engines, consisting in noting the electromagnetic influences associated with the passage of a vehicle, by means of at least one electromagnetic loop (2), disposed on or within the roadway (1) and having a small dimension in the direction of displacement of the vehicles or of the axis (X) of the roadway (1), characterized in that it consists, by means of at least one loop (2) whose dimension (1) or width is about of the order of size of the width of the bearing surface on the ground of the vehicles to be analyzed, in noting first the opposite variations of voltage and/or frequency of an alternating signal moving within the loop or loops (2) associated, on the one hand, with the wheels of the vehicles and, on the other hand, with the body or chassis of said vehicles, in treating the signal proportional to said variations to produce a signal indicating the number and position of the wheels relative to each other and relative to the body of the vehicle, in identifying the precise nature of the analyzed vehicle and in classifying this latter within predetermined categories, based essentially on the number and longitudinal arrangement of the wheels or of the axles, and in storing the received data for a determined period of time for their ultimate use, for reading in situ and/or remotely, with transfer if desired of its contents.

13. Process according to claim 12, characterized in that it consists in noting the variation of electromagnetic magnitudes or frequency or of voltage of an alternating signal moving within the loop (2), during passage of a vehicle over the latter, according to the electromagnetic influence, particularly as to the inductance of the loop or loops (2) of the body or the chassis of the vehicle, on the one hand, and by the corresponding wheels, on the other hand.

14. Process according to claim 12, characterized in that it consists by means of several independent loops (2) disposed perpendicularly to the axis (X) of the roadway (1) and each producing its own signal, in noting transversely the position of one or several signal or double wheels of a given vehicle, and therefore the position of this latter on the lane (1'), and in scanning by longitudinal sections said vehicle, thereby permitting reconstituting the print or the magnetic signature of said vehicle permitting its comparatively precise identification.

15. Process according to claim 12, characterized in that it consists in also determining the length of the body or of the chassis and the distances between the roadway (1) and the bottom of the chassis between the axles, on the one hand, and forwardly and rearwardly of the axles, on the other hand.

16. Process according to claim 12, characterized in that it consists in the supplemental use of an ultrasonic detector, to determine the profile or silhouette of the vehicle to be analyzed.

17. Process according to claim 12, characterized in that it consists in the supplemental use of an electromagnetic loop (2') of large size, associated with a loop (2) constituted by the same conductive wire, to determine also by analysis of the received signal, the speed of displacement and the length of detected vehicles.

18. Process according to claim 12, characterized in that it consists first of effecting the installation of the loop or loops (2) in the roadway (1) by means of a saw permitting obtaining suitable prints or cutouts in said roadway (1).

* * * * *